US009476285B2

(12) United States Patent
Zhou

(10) Patent No.: US 9,476,285 B2
(45) Date of Patent: Oct. 25, 2016

(54) MULTI-LATERAL RE-ENTRY GUIDE AND METHOD OF USE

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 435 days.

(21) Appl. No.: 14/063,016

(22) Filed: Oct. 25, 2013

(65) Prior Publication Data

US 2014/0116728 A1 May 1, 2014

Related U.S. Application Data

(60) Provisional application No. 61/719,124, filed on Oct. 26, 2012.

(51) Int. Cl.

| | |
|---|---|
| ***E21B 23/02*** | (2006.01) |
| ***E21B 41/00*** | (2006.01) |
| ***E21B 23/12*** | (2006.01) |

(52) U.S. Cl.

CPC ..... *E21B 41/0035* (2013.01); *E21B 23/002* (2013.01)

(58) Field of Classification Search

CPC ..... E21B 23/002; E21B 41/0035

See application file for complete search history.

(56) References Cited

U.S. PATENT DOCUMENTS

| | | | |
|---|---|---|---|
| 5,228,518 A | 7/1993 | Wilson et al. | |
| 5,415,238 A | 5/1995 | Nice | |
| 5,427,177 A | 6/1995 | Jordan, Jr. et al. | |
| 5,887,655 A | 3/1999 | Haugen et al. | |
| 6,527,067 B1 * | 3/2003 | Ravensbergen | E21B 41/0035 175/381 |
| 6,658,930 B2 | 12/2003 | Abbas | |
| 6,729,399 B2 | 5/2004 | Follini et al. | |
| 6,752,211 B2 | 6/2004 | Dewey et al. | |
| 8,069,920 B2 | 12/2011 | Cronley et al. | |
| 8,316,937 B2 | 11/2012 | Cronley et al. | |
| 2001/0042621 A1 | 11/2001 | Leising | |
| 2002/0079102 A1 | 6/2002 | Dewey et al. | |
| 2004/0262006 A1 | 12/2004 | Dewey et al. | |
| 2006/0042792 A1 | 3/2006 | Connell | |
| 2010/0252275 A1 | 10/2010 | Cronley et al. | |
| 2012/0061148 A1 | 3/2012 | Clausen et al. | |
| 2014/0138084 A1 | 5/2014 | Al-Mulhem | |

FOREIGN PATENT DOCUMENTS

EP 2740886 A1 6/2014

OTHER PUBLICATIONS

PCT The International Search Report and The Written Opinion of the International Searching Authority dated Sep. 2, 2014; International Application No. PCT/US2013/066725; International File Date: Oct. 25, 2013.

* cited by examiner

*Primary Examiner* — William P Neuder
(74) *Attorney, Agent, or Firm* — Bracewell LLP; Constance G. Rhebergen; Keith R. Derrington

(57) ABSTRACT

A downhole tool for use in a multilateral wellbore includes a guide member on one end that selectively projects into a designated wellbore, where the designated wellbore can be a motherbore or a lateral wellbore. Pistons are set radially in a body of the tool that selectively push against an end of the guide member to pivot it into a designated orientation to guide the tool into the designated wellbore. The pistons are hydraulically actuated when probes that are on sides of the tool body extend outward into contact with a lateral wellbore. The probes block hydraulic flow when retracted, but when deployed outward they allow fluid communication to push the pistons against the guide member.

20 Claims, 12 Drawing Sheets

MULTI-LATERAL RE-ENTRY GUIDE AND METHOD OF USE

CROSS REFERENCE TO RELATED APPLICATIONS

This application claims priority to and the benefit of U.S. Provisional Application Ser. No. 61/719,124, filed Oct. 26, 2012, the full disclosure of which is hereby incorporated by reference herein for all purposes.

BACKGROUND OF THE INVENTION

1. Field of the Invention

The present invention relates to operations in a wellbore. More specifically, the invention relates to a system and method for steering a downhole device into a designated branch of a multilateral well circuit.

2. Description of the Related Art

Hydrocarbon producing wellbores extend subsurface and intersect subterranean formations where hydrocarbons are trapped. Well drilling techniques now include forming multilateral wells that include branches or laterals that extend from the motherbore. While most wellbores are lined with casing, sonic branched portions were left unlined to save cost, However, the openhole portions tend to produce an undesirable amount of water. While a workover on the well can be done to block water production, any workover involving entry into a branched portion can be lengthy, costly, and introduce risk due to uncertainties in entering the branched portion. Because branches are usually drilled using special drill steering devices, and are not easily accessible by most downhole tools. Entering a particular lateral is often done by trial and error using a bent-sub as a guide and rotating an associated tool string in order to orient the guide. A measurement while drilling (MWD) device on a tool is sometimes used to help orient the guide, and a retrievable bridge plug (also drillable) is sometimes installed in the motherbore in connection with these techniques to act as a temporary barrier. So if a lateral wellbore is tagged by any tool at the bottom of the string, the tool string can be pulled back up and reworked into the desired lateral wellbore. This is not always practical because typical completion equipment has a limited torque capability and often requires a ball operated pressure release device that precludes use of a MWD tool. Also, rotation completion equipment accidently across the window exit from the motherbore can damage the equipment. Existing sensing and guiding tool systems are typically conveyed on coiled tubing or on wireline. Another approach sometimes employed involves running and setting a retrievable whipstock in the exact location and orientation of a previous whipstock location, so that it can easily guide any work string into the lateral wellbore. However, this approach is not often attempted because setting a whipstock at an exact location and orientation along an existing wellbore remains a challenge; also retrieval of the whipstock may not be always assured.

SUMMARY OF THE INVENTION

Disclosed herein is an example of a system and method for navigating through a multilateral wellbore having a motherbore and a lateral wellbore. In one embodiment, disclosed herein is a guide system for use in a multiplateral wellbore which includes a body, a probe assembly selectively extendable from a lateral side of the body. The probe assembly can be moved between an undeployed position in contact with a wall of the motherbore, and a deployed position in contact with a wall of the lateral wellbore. The system of this embodiment includes a guide member projecting from an end of the body and directed towards a designated wellbore when the probe assembly is in the deployed position. Also included is a steering system in the body that is in communication with the probe assembly. The steering system is selectively moveable into contact with the guide member, and when in contact with the guide member, the steering system can be moved from an orientation where the guide member is directed away from the designated wellbore and to an orientation where the guide member is directed towards the designated wellbore. Examples exist where the designated wellbore is the motherbore or the lateral wellbore. A fluid passage can be included in the body that extends between the probe assembly and the steering system. In this example, the probe assembly includes a cylinder that extends radially outward from a bore in the body and that is intersected by the fluid passage, a piston head axially slidable in the cylinder, and a probe tip connected to the piston head by a rod. In this configuration, when the probe tip is adjacent a wall of the lateral wellbore, pressurized fluid in the bore urges the piston head, rod, and probe tip radially outward into contact with the wall of the lateral wellbore. Further in this embodiment, the probe assembly is in the deployed position when the piston head is urged radially outward from where the passage intersects the cylinder and wherein the pressurized fluid from the bore is directed to the steering system through the passage. The steering system can include a cylinder intersected by the passage, a piston head slidable in the cylinder, a rod projecting radially inward from the piston head that contacts the guide member, and a spring biasing the piston head radially outward. Resilient members can optionally be included that attach to sides of the guide member and keep the guide member substantially collinear with an axis of the body when the probe assembly is in the undeployed position. In an example, the probe assembly and steering system are at substantially distal azimuthal locations on the body, and wherein the designated wellbore is a motherbore. Optionally included are a plurality of probe assemblies in the body and a plurality of steering systems positioned in the body, so that each of the steering systems are at about the same angular position as a corresponding probe assembly, and so that when one of the probe assemblies is in a deployed position, a corresponding steering system is moved into contact with the guide member to orient the guide member into a designated wellbore.

Also disclosed herein is a tool string insertable into a multilateral wellbore having lateral wellbores that branch from a motherbore. In this example the tool string is made up of a tubing string that selectively receives pressurized fluid from a fluid source, a tool body attached to an end of the tubing string, a bore in the tool body in fluid communication with the pressurized fluid, a guide member pivotingly mounted in the body and having a portion extending from an end of the body, a flow path in the body in fluid communication with the bore in the tool body, and a probe assembly in the body selectively moveable in a position that defines a flow barrier in the flow path and in contact with a wall of the multilateral wellbore, to a position offset from the flow path and projecting into the lateral wellbore. Also included with this example is a steering assembly mounted in the body having an end in communication with the flow path and moveable against the guide member to an orientation where the guide member is directed towards either the motherbore or the lateral wellbore when the probe is offset from the flowpath. The probe assembly and steering assembly can be set at about the same azimuthal location on the body and the designated wellbore is a lateral wellbore. Optionally, the probe assembly and steering assembly can be set at substantially distal azimuthal locations on the body. In this example the designated wellbore is a motherbore. In an example, the probe assembly is made up of a cylinder in the body that projects radially outward from the bore in the body, a piston assembly set in the cylinder having a piston head with a inner surface facing the bore, a piston rod on an outer surface, a probe tip on an end of the rod distal from the piston head, and a spring exerting a radially inward biasing force onto the piston head, piston rod, and probe tip. In this example, the steering assembly is made up of a cylinder in the body that projects radially inward to intersect with the bore in the body and a piston assembly set in the cylinder having a piston head with an outer surface and a rod on an inner surface of the piston head. A flow passage can optionally be provided in the body, where the passage has an end connected with the cylinder in the probe assembly and a distal end connected with the cylinder in the steering assembly. The tool string can further include a plurality of probe assemblies, and a plurality of steering assemblies, wherein each steering assembly is set at the same azimuthal location in the body as a corresponding probe assembly. Further optionally provided are selectively deployable packers for controlling fluid flow in the wellbore.

Further disclosed herein is an example method of selective insertion into a designated wellbore, where the designated wellbore is part of a multilateral wellbore. The method can include providing a steering tool having an elongated guide projecting from a body of the steering tool, inserting the steering tool into the multilateral wellbore, identifying an entrance to a lateral wellbore by sensing a wall of a wellbore surrounding the body, and directing the guide towards the designated wellbore based on the step of identifying the entrance to the lateral wellbore. The step of identifying the entrance can involve urging probes radially outward from the body at azimuthally spaced locations around the body, and wherein probes proximate the entrance extend past probes distal from the entrance. In one example, the designated wellbore is the lateral wellbore, the guide is directed towards the lateral wellbore, and wherein when the designated wellbore is the motherbore, the guide directed away from the lateral wellbore.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
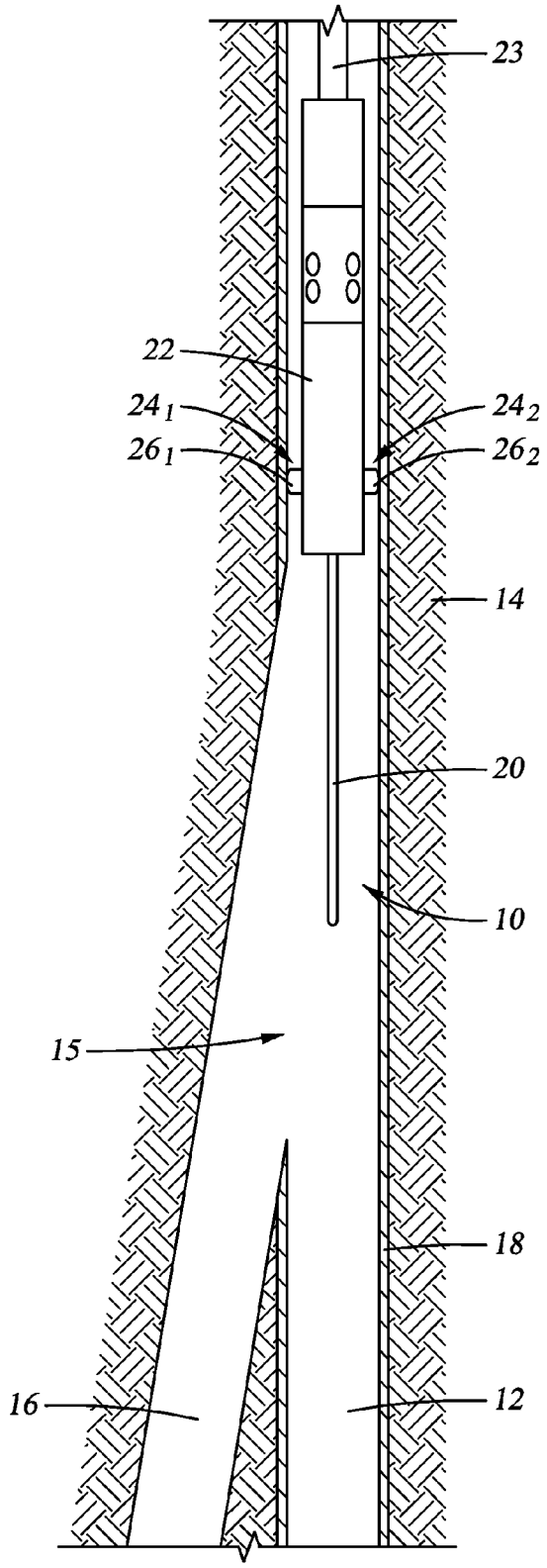
FIG. 1 is a side partial sectional view of an example embodiment of a downhole tool for guiding a downhole string into a designated wellbore of a multilateral well and in accordance with the present invention.

FIG. 1 is a partial side sectional view of an example of a downhole tool 10 disposed in a motherbore 12 that extends through a. formation 14. The tool 10 is adjacent a window 15 that defines an entrance to a branch or lateral wellbore 16 shown extending at an angle oblique to an axis of the motherbore 12. Further in the example of FIG. 1, the motherbore 12 is lined with casing 18, whereas the lateral wellbore 116 of FIG. 1 is uncased or open. A tool guide 20 is included on the tool 10, which is an elongated member that extends axially from an end of a body 22 of the tool 10. The tool 10 is shown deployed on a lower end of a tubular string 23, which in an example can be a string of drill pipe or a length of coiled tubing.

Figure 2:
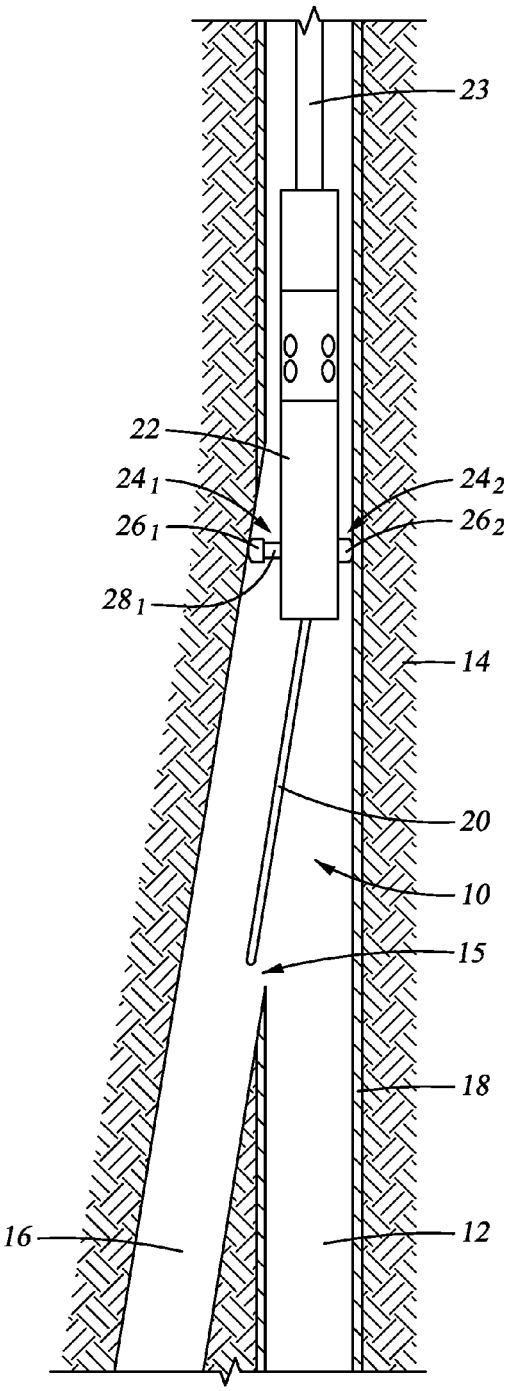
FIGS. 2 and 3 are side partial sectional views of the downhole tool of FIG. 1 steering into a designated wellbore in accordance with the present invention.

In FIG. 2, tubular string 23 has been lowered to urge the tool 10 deeper into the motherbore 12, so that a portion of the body 22 having probe assemblies $\mathbf{24}_1$, $\mathbf{24}_2$ is past the initial part of the window 15. Probes $\mathbf{24}_1$, $\mathbf{24}_2$ are shown having probe tips $\mathbf{26}_1$, $\mathbf{26}_2$ on their outer ends distal from body 22; each of the probe tips $\mathbf{26}_1$, $\mathbf{26}_2$ are in contact with a wall of an adjacent wellbore. As the tool 10 has been urged past an upper edge of window 15, the side of lateral wellbore 16 angles away from the body 22, allowing probe tip $\mathbf{26}_1$ to extend outward into contact with wall of lateral wellbore 16 and revealing a rod $\mathbf{28}_1$ on which the probe tip $\mathbf{26}_1$ is mounted. As will be described in more detail below, by extending probe $\mathbf{24}_1$ radially outward from body 22 tool guide 20 is pivoted with respect to an axis of the body 22; and oriented for insertion into lateral wellbore 16.

Figure 3:
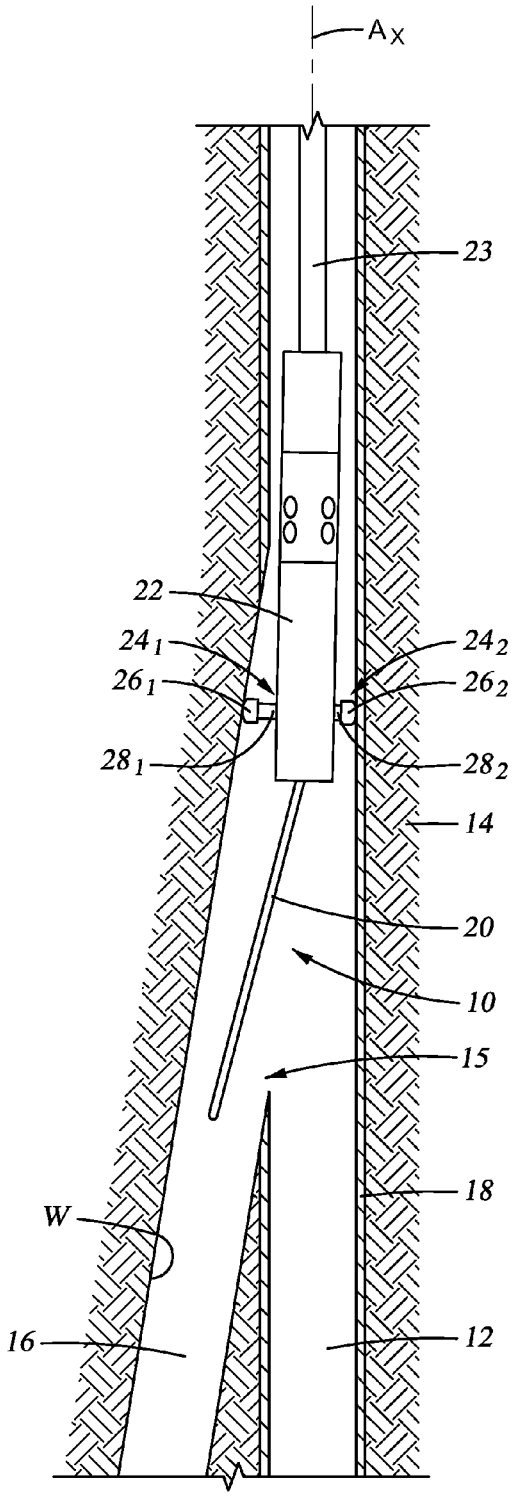

FIG. 3 illustrates further insertion of the tool 10 into motherbore 12 with lowering of the tubular string 23, and where an end of tool guide 20 distal from body 22 intersects the window 15 and extends into lateral wellbore 16. Also, as the tool 10 is inserted deeper into motherbore 22, the distance increases between axis $A_X$ of motherbore 12 and a distal portion of lateral wellbore wall W; which allows probe tip $26_1$ to extend radially farther outward from the body 22 and from its position of FIG. 2. Additionally shown in FIG. 3 is that probe $26_2$ extends out into contact with casing 18 showing rod $28_2$ projecting radially outward from a side of the body 22 distal from rod $28_1$. In the example of FIG. 3, body 22 shifts radially within motherbore 12 towards lateral wellbore 16 thereby allowing extension of probe $26_2$ away from body 22.

Figure 4:
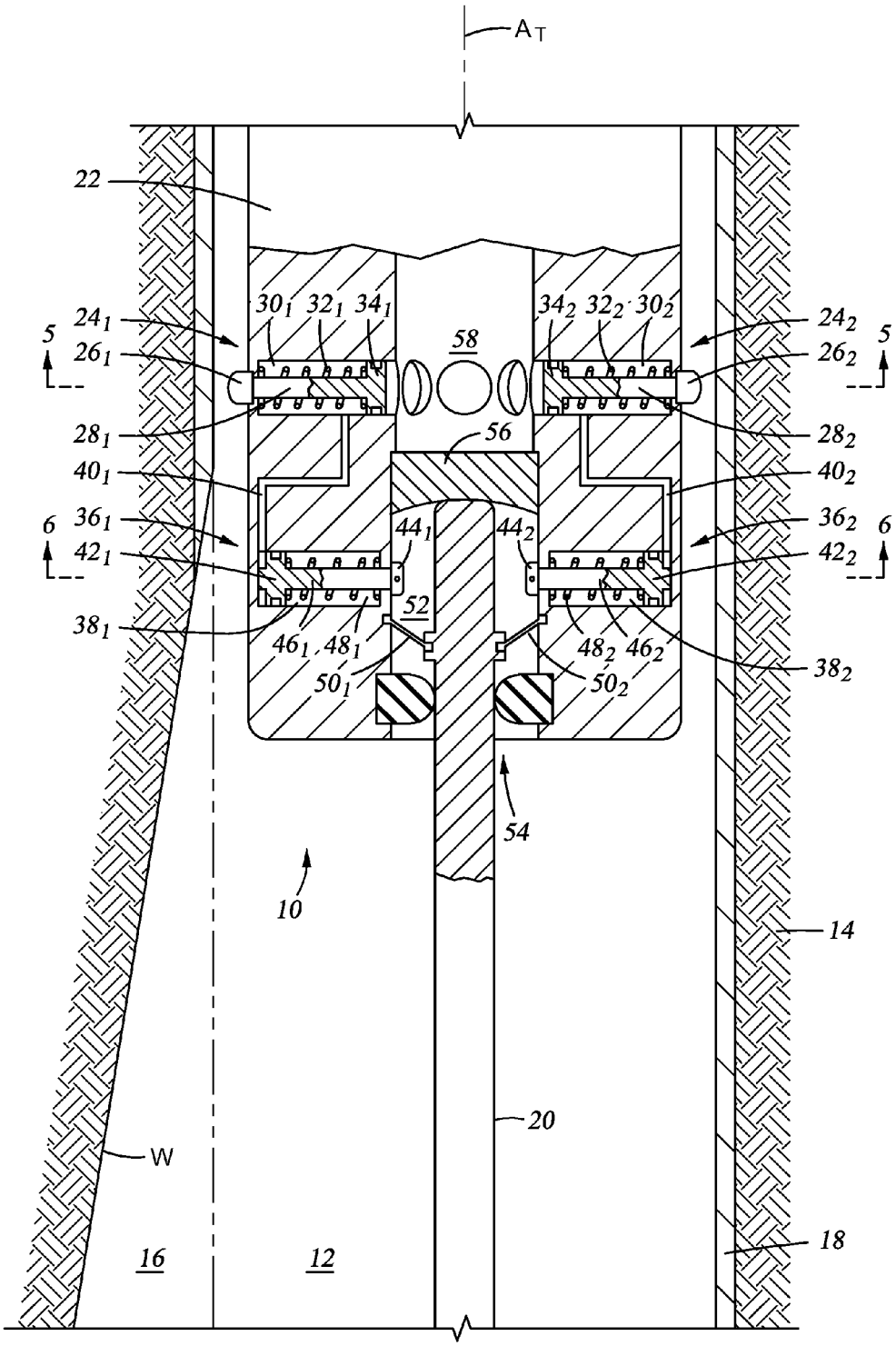
FIG. 4 is a side sectional view of a portion of the downhole tool of FIG. 1 in accordance with the present invention.

FIG. 4 is a side sectional view of a portion of tool 10 and illustrating that rods $28_1$, $28_2$ are reciprocatingly disposed in cylinders $30_1$, $30_2$ that are formed in the body 22 and project radially outward from an axis $A_T$ of tool 10. The respective diameters of cylinders $30_1$, $30_2$ transition inward proximate the outer surface of tool 10. Springs $32_1$, $32_2$ provide one example of how the rods $28_1$, $28_2$ can be urged radially outward from tool 10 and against wall W as the lateral wellbore 16 angles away from motherbore 12. (FIG. 3). Further shown in FIG. 4 are piston heads $34_1$, $34_2$ that mount on ends of the rods $28_1$, $28_2$ distal from probe tips $26_1$, $26_2$. In an example, the outer surfaces of piston heads $34_1$, $34_2$ sealingly contact and are slidable within the larger diameter portions of cylinders $30_1$, $30_2$, whereas the smaller diameter portions define a backstop to piston heads $34_1$, $34_2$, which prevents piston heads $34_1$, $34_2$ from sliding out from body 22. Rods $28_1$, $28_2$ however are freely slidable through the smaller diameter portions of cylinders $30_1$, $30_2$.

Axially spaced away from probes $24_1$, $24_2$ are piston assemblies $36_1$, $36_2$ shown disposed in cylinders $38_1$, $38_2$. In the example of FIG. 4, cylinders $38_1$, $38_2$ are formed radially within the body 22 of tool 10 and spaced axially away from cylinders $30_1$, $30_2$ and towards the forward end of tool 10. A passage $40_1$ is shown having one end intersecting a side of cylinder $30_1$, extending through the body 22, and having an opposite end that intersects with cylinder $38_1$. Passage $40_1$ thus provides communication between cylinder $30_1$ and cylinder $38_1$. Similarly, passage $40_2$ extends through body 22 and connects and provides communication between cylinders $30_2$, $38_2$. The piston assemblies $36_1$, $36_2$ of FIG. 4 further respectively include an outer piston $42_1$, $42_2$ shown disposed in cylinders $38_1$, $38_2$ distal from axis $A_T$ Inner pistons $44_1$, $44_2$ are shown in a portion of cylinders $38_1$, $38_2$ proximate to axis $A_X$; piston rods $46_1$, $46_2$ connect inner pistons $44_1$, $44_2$ with outer pistons $42_1$, $42_2$. Springs $48_1$, $48_2$ are set between inner radially facing surfaces of outer pistons $42_1$, $42_2$ and a backstop in cylinders $38_1$, $38_2$ proximate to axis $A_T$; thereby outwardly biasing the piston assemblies $36_1$, $36_2$.

Elongated resilient members $50_1$, $50_2$ are shown each having an end connected with a wall of an axial bore 52 formed in tool body 22. Ends of resilient members $50_1$, $50_2$ distal from the wall connect to lateral sides of a portion of tool guide 20 shown inserted into bore 52. Bore 52 has a reduced radius on an end of the tool body 22 distal from probes $24_1$, $24_2$ to define a collar 54. In the example of FIG. 4, the collar 54 has an inner diameter in close contact with an outer diameter of tool guide 20, so that the tool guide 20 can pivot about a circular interface where tool guide 20 selectively contacts collar 54. Further, movement of the tool guide 20 can be dampened by stretching of the resilient members $50_1$, $50_2$. In an embodiment, tension in resilient members $50_1$, $50_2$ can be selectively set to maintain tool guide 20 substantially parallel with axis $A_T$. An upper end of bore 52 terminates at a bulkhead 56 that extends across the diameter of bore 52; and which provides a backstop for an end of the tool guide 20 inserted within tool body 22. Another bore 58 is shown axially formed in tool body 22 on a side of the bulkhead 56 opposite bore 52. In an example, bulkhead 56 isolates bore 52 from bore 58.

Figure 5:
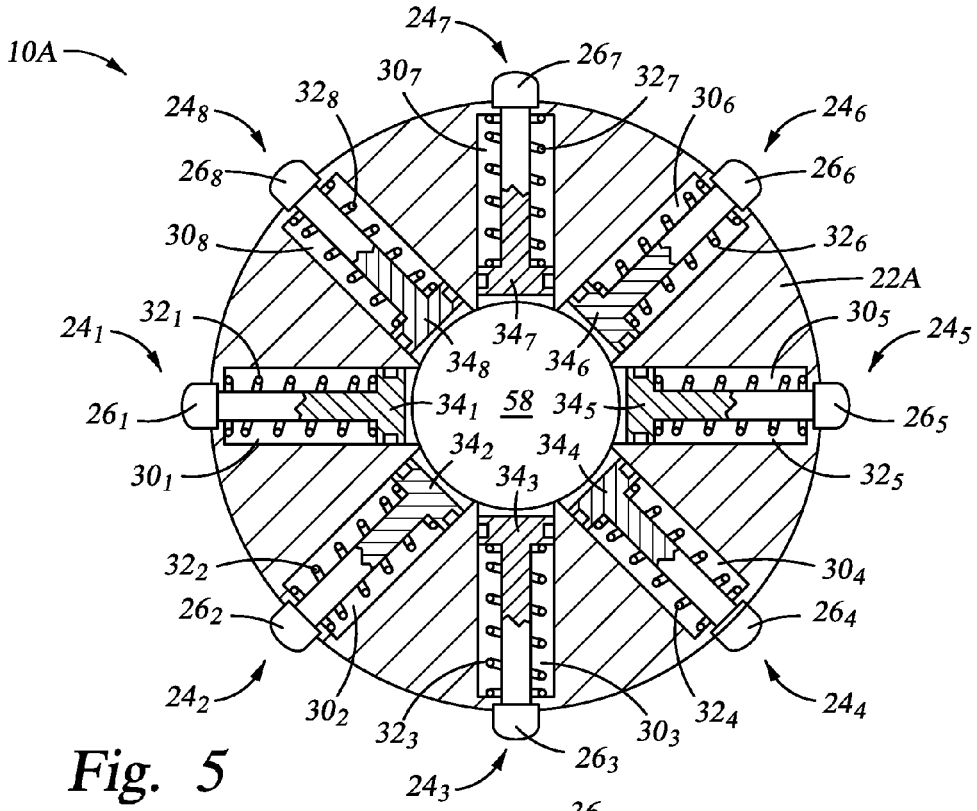
FIGS. 5 and 6 are axial sectional views of the portion of the downhole tool of FIG. 4 taken respectively along lines 5-5 and 6-6 and in accordance with the present invention.
Figure 6:
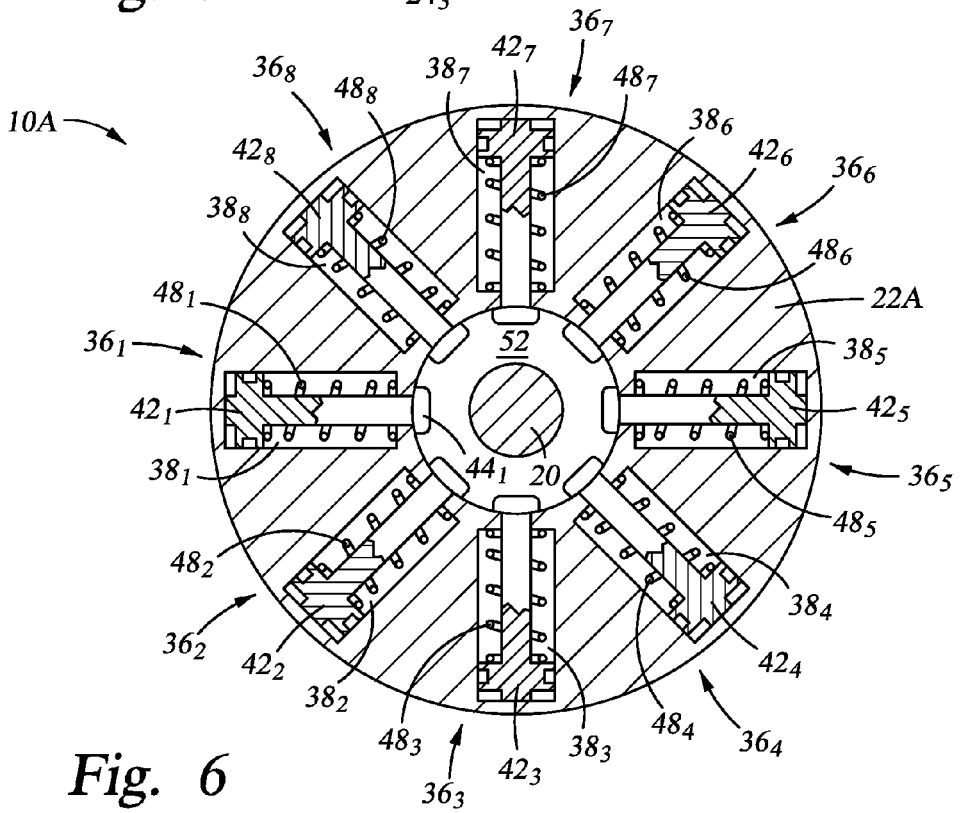

FIGS. 5 and 6 illustrate axial views of an example embodiment of a tool 10A, where instead of a pair of probe assemblies, as shown in FIGS. 1-3, up to 8 probe assemblies $24_1$-$24_8$ are illustrated set in the tool body 22A. Similarly, in FIG. 6, a series of 8 piston assemblies $36_1$-$36_8$ are shown set within tool body 22A. In the examples of FIGS. 5 and 6, the probe assemblies $24_1$-$24_8$ and piston assemblies $36_1$-$36_8$ are each oriented to project radially inward to the center of tool body 22A and along paths that are at substantially equidistant angles with each adjacent path. Further shown in FIGS. 5 and 6 are that cylinders $30_1$-$30_8$ and cylinders $38_1$-$38_8$ extend only along a portion of the radial thickness of the tool body 22A. Referring back to FIG. 4, while probe tips $26_1$, $26_2$ project radially outward past an outer surface of tool body 22, outer pistons $42_1$, $42_2$ remain within their respective cylinders $38_1$, $38_2$, which are set radially inward from the outer surface of tool body 22. Similar to that of FIG. 4, in the example of FIGS. 5 and 6, probe assemblies $24_1$-$24_8$ and piston assemblies $36_1$-$36_8$ are illustrated in an undeployed position. Moreover, while the tool 10 is in the undeployed state, tool guide 20 remains substantially parallel with axis $A_T$.

Figure 7:
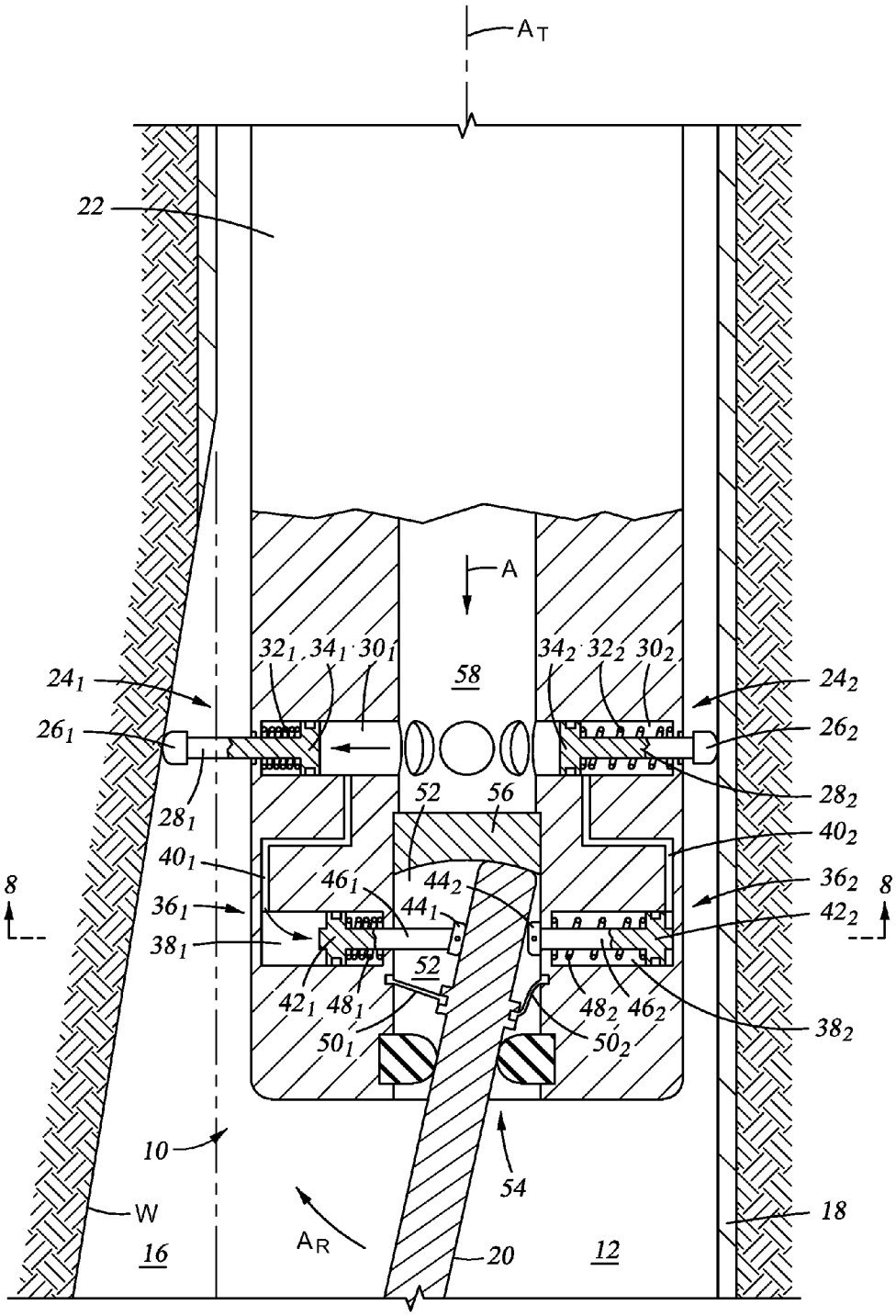
FIG. 7 is a side sectional view of the portion of the downhole tool of FIG. 4 during an example of operation and in accordance with the present invention.

FIG. 7 is a side sectional view of the tool 10 of FIG. 4 in an example of a deployed state and similar to the embodiment of FIG. 3; wherein probe assembly $24_1$ has extended radially outward from tool body 22 in response to the angling away of lateral wellbore wall W. An example of positioning probe assembly $24_1$ into a deployed state includes pressurizing bore 58, as illustrated by arrow A, which urges the probe assembly $24_1$ and piston head $34_1$ radially outward. Continued urging of the probe assembly $24_1$ with pressurized fluid slides piston head $34_1$ in cylinder $30_1$ past an entrance to passage $40_1$. Moving piston head $34_1$ as shown opens a communication path between bore 58 and cylinder $38_1$ via cylinder $30_1$ and passage $40_1$. When the communication path is open, pressurized fluid flowing through passage $40_1$ imparts a radially inward force against an outer facing surface of outer piston $42_1$. Providing the fluid above a designated pressure maintains the force on the outer piston $42_1$ at a value that exceeds the outward biasing force of spring $48_1$. Overcoming the force of spring $48_1$ urges piston assembly $36_1$ radially inward and so that inner piston $44_1$ pushes laterally against the tool guide 20. Inner piston $44_1$ contacts tool guide 20 within bore 52, at a location axially offset from a mid-portion of tool guide 20; thereby pivoting tool guide 20 about collar 54 and in a direction of rotation illustrated by arrow $A_R$. As shown, resilient member $50_1$ stretches when the tool guide 20 is pivoted, the urging force from piston $44_1$ also overcomes the centralizing force exerted by resilient member $50_1$ onto tool guide 20.

Further illustrated in FIG. 7 is that probe tip $26_2$ of probe assembly $24_2$ is in contact with casing 18 lining the motherbore 12, and thus probe assembly $24_2$ remains retracted and adjacent toot body 22 in an undeployed state. When probe assembly $24_2$ is undeployed, piston head $34_2$ is between passage $40_2$ and bore 58 and blocks communication of pressurized fluid in bore 58 to piston assembly $36_2$ via passage $40_2$. As such, the piston assembly $36_2$ remains biased radially outward and away from contact with tool guide 20. In this example, strategically porting flow through a passage in the tool body between a probe assembly and piston assembly that are at about the same azimuth on the tool body 22 can orient a tool guide 20 into a lateral wellbore branching from a motherbore. Although the example of FIG.

Figure 8:
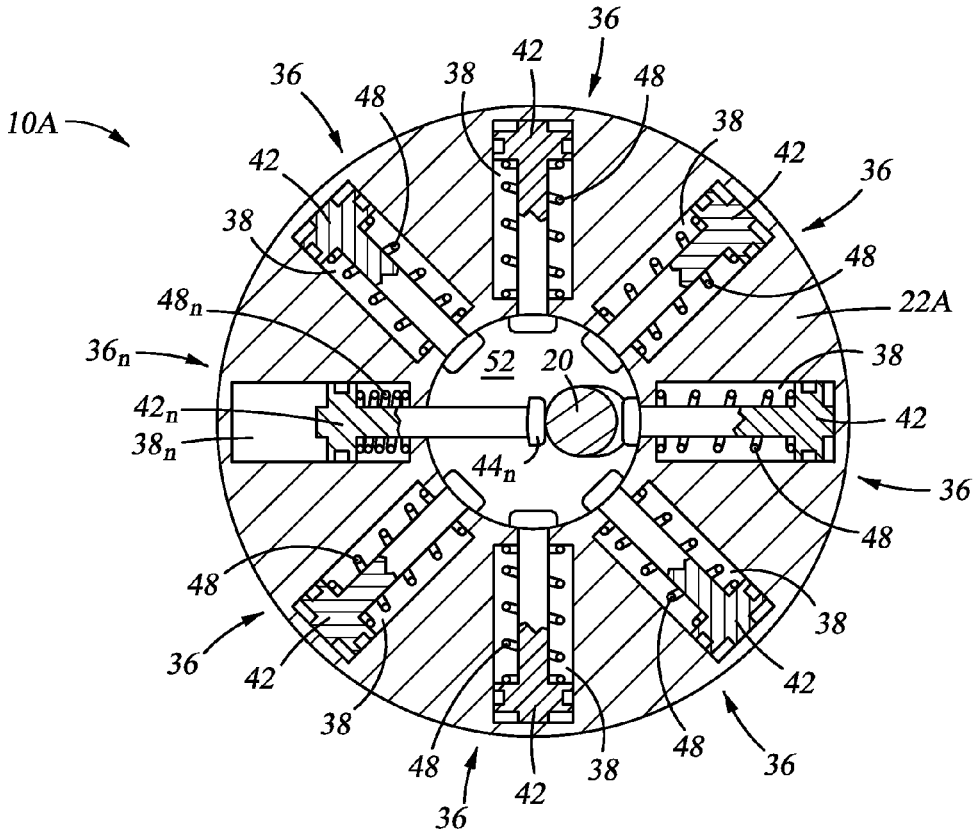
FIG. 8 is an axial sectional view of the downhole tool of FIG. 7 taken along lines 8-8 and in accordance with the present invention.

7 illustrates two probe assemblies $24_1$, $24_2$ and two piston assemblies $36_1$, $36_2$, the embodiments of FIGS. 5 and 6 having up to eight or more probe and piston assemblies are included within the scope of this application. FIG. 8 shows an axial view of the example of the tool 10 of FIG. 7 and taken along lines 8-8. FIG. 8 illustrates an example where up to eight piston assemblies $36_1$-$36_8$ can be employed in the tool 10A and where one of the assemblies $36_n$, is urged radially inward to pivot the tool guide 20.

Figures 9A, 9B, 9C, 9D, 9E:
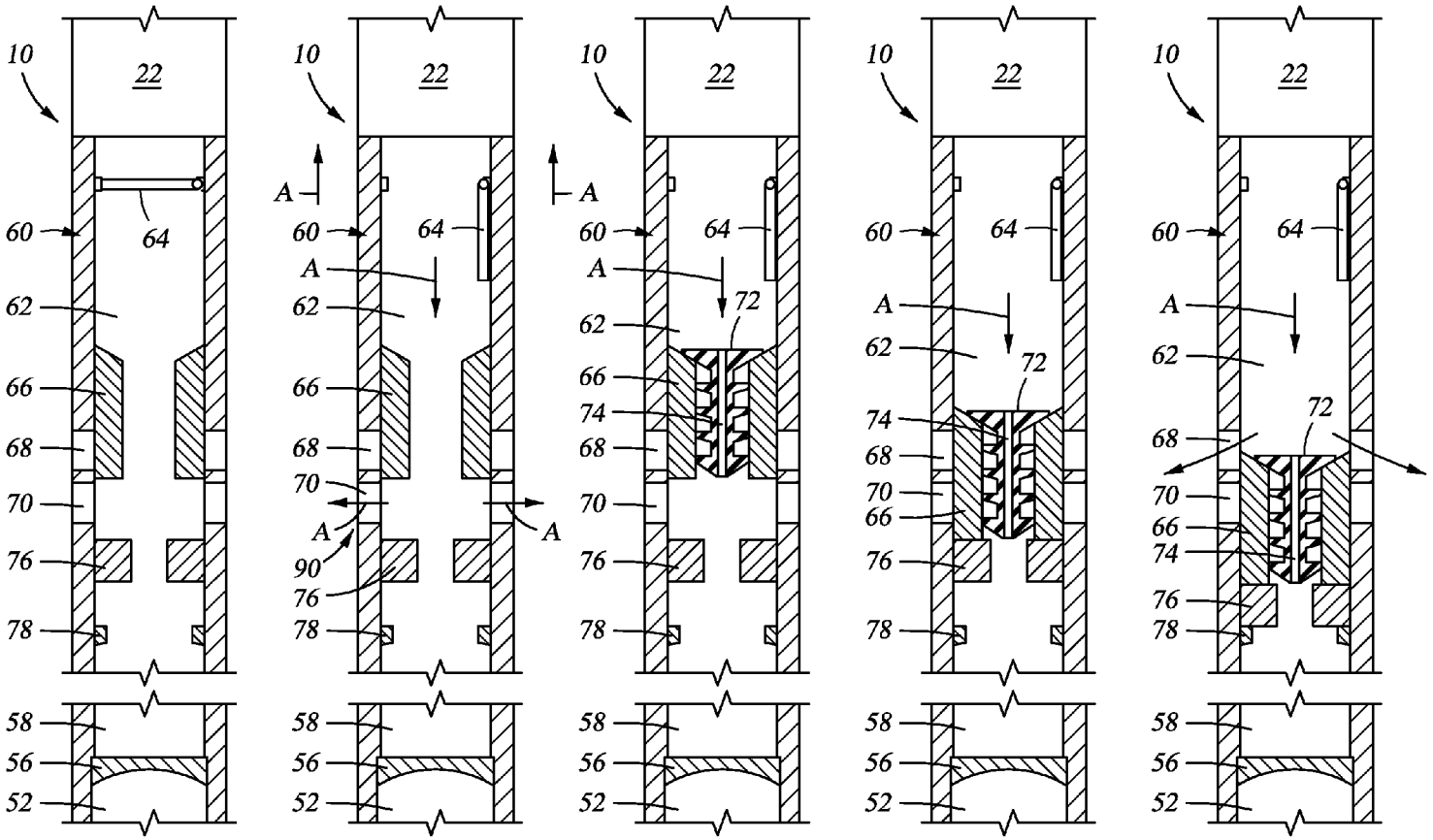
FIGS. 9A-9E are side sectional views of an example of activating the downhole tool of FIG. 1 in accordance with the present invention.

FIGS. 9A through 9E illustrate how fluid may be selectively circulated axially through the tool 10, and then directed within the tool 10 for actuating the piston assemblies $36_1$-$36_8$ (FIG. 5). Referring to FIG. 9A, a circulating sub 60 is shown which defines a part of the tool 10 upstream from bulkhead 56. Circulating sub 60 is a general annular member having a bore 62 along its axis and a generally disk-like flapper valve 64 shown in a closed position to block flow through the bore 62, and on an upstream end of the sub 60, A sleeve 66 is coaxially set in the bore 62 inside a mid-portion of the circulating sub 60 and extends along a length of the bore 62. In the example of FIG. 9A, the sleeve 66 is set adjacent ports 68 formed radially through a sidewall of circulating sub 60, thereby blocking communication between bore 62 and outside of sub 60. Referring to FIG. 9B, the flapper valve 64 is shown moved from a closed position of FIG. 9A into an open position; where the valve 64 is in a plane that is generally parallel within axis of the sub 60. Arrows A illustrate an example of fluid flow circulation through the bore 62, past sleeve 66, and radially out from the sub 60 through ports 70 that project through a sidewall of sub 60. Fluid flow can be supplied by a fluid source (not shown), that in an example includes mud pumps on the Earth's surface adjacent an opening of the motherbore 12. The ports 70 are axially past an end of sleeve 66 and on a side of sleeve 66 distal from flapper valve 64. In the example of FIG. 9B, the flow can be recirculated back up the wellbore in which tool 10 is inserted, e.g. motherbore 12 or lateral wellbore 16.

An example of initiation of a steering function of tool 10 is illustrated in the example of FIG. 9C wherein a dart 72 has been dropped down tool string 23 (FIG. 1) attached to an upper end of the tool 10 and falls into the bore 62. In the example, the dart 72 includes an elongated body with a conically shaped head on a lower end of the body. A series of disk-like ridges circumscribe the body and are axially spaced apart, each ridge having an outer circumference less than an inner circumference of sleeve 66. The dart 72 further includes a frusto-conically shaped base whose outer diameter exceeds an inner diameter of sleeve 66, so that the base lands on an upper end of sleeve 66 whereas the head and ridges insert within sleeve 66. A bypass 74 is formed axially through the length of dart 72 that provides a flow path through dart 72, but whose cross sectional area is less than that of bore 62. As shown in FIG. 9D, while an amount of fluid can flow through the bypass 74, flowing pressurized fluid into bore 62 and above dart 72 generates a force that is applied onto an upper surface of dart 72. Flowing enough pressurized fluid through bore 62 and dart 72 generates a sufficient force onto dart 72, which transfers to and dislodges sleeve 66 from its location in bore 62 of FIG. 9C into that shown in FIG. 9D. In FIG. 9D, sleeve 66 is shown moved axially downward away from flapper valve 64 landed on an intermediate stop ring 76 shown coaxially set in the bore 62. Intermediate stop ring 76 is an annular member strategically located in bore so that sleeve 66 is adjacent ports 68, 70 when it lands on stop ring 76. When adjacent ports 68, 70, sleeve 66 blocks communication through ports 68, 70 and fluid is trapped inside bore 62. As such, when tool 10 is in the configuration of FIG. 9D, fluid flow entering the bypass sub 60 passes through bore 62 and flows into bore 58 downstream of sleeve 66.

FIG. 9E illustrates an example wherein steering operations have been completed, and circulation is desired to take place. In this example of operation additional flow is provided to sub 60 to increase fluid pressure drop through dart 72, which translates to an increased axial force being applied to sleeve 66 and intermediate stop ring 76. Intermediate stop ring 76 is slidable with an application of a sufficient amount of applied force. Accordingly, pressure in the bore 62 of FIG. 9E is greater than pressure in the bore of FIG. 9D. FIG. 9E illustrates an example of when a sufficient amount of force is applied to intermediate stop ring 76, via sleeve 66 and dart 72, and intermediate stop ring 76 begins to slide axially until contact is made with a lower stop ring 78. Lower stop ring 78 is axially fixed within sub 60 and in interfering contact with intermediate stop ring 76, so that further axial movement of the dart 72 and sleeve 66 is prevented by lower stop ring 78. Lower stop ring 78 is strategically located so that when intermediate stop ring 76 lands onto lower stop ring 78, an end of sleeve 66 distal from intermediate stop ring 76 is past ports 68, thus allowing flow from bore 62, out of ports 68, and into an annulus between tool 10 and walls of a wellbore in which the tool 10 is inserted.

Figure 10A:
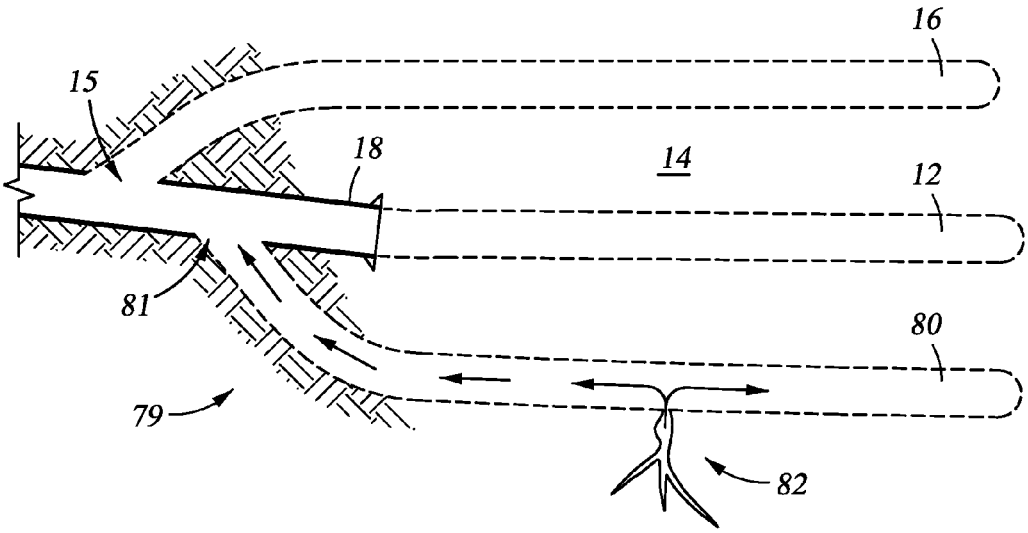
FIGS. 10A-10D are side sectional views of the downhole tool of FIG. 1 in use in a multilateral well and in accordance with the present invention.
Figure 10B:
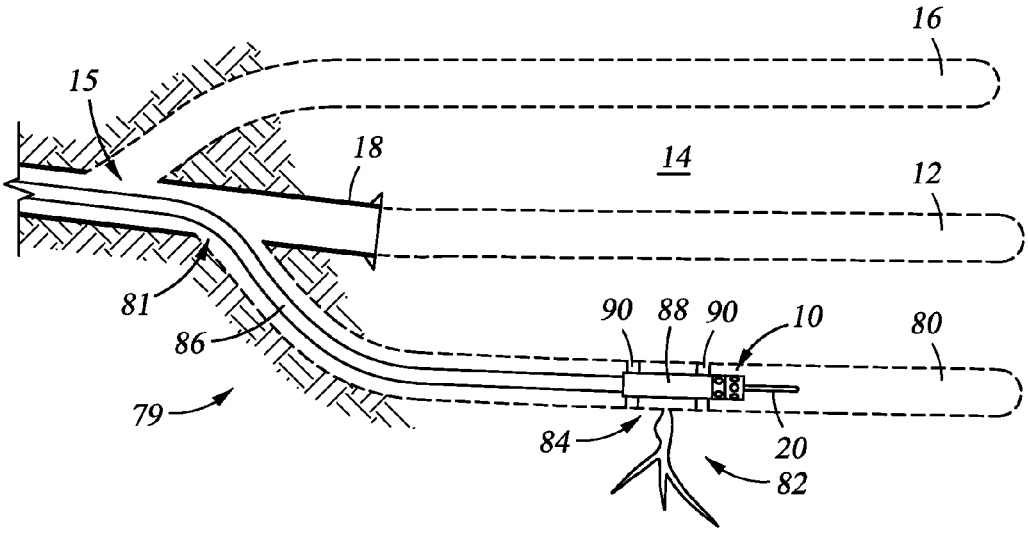

FIGS. 10A through 10D illustrate operation within a multilateral wellbore circuit 79 formed in formation 14. In the example of FIG. 10A, motherbore 12 includes lateral wellbore 16 and also a lateral wellbore 80. Window 81 defines an intersection between motherbore 12 and lateral wellbore 80, where window 81 is farther downhole than window 15. A water producing zone 82 is shown intersecting wellbore 80, and that contributes water into the multilateral wellbore 79; water flow is represented by arrows in lateral well 80. As shown in FIG. 10B, an example of addressing the inflow of water includes mounting the downhole tool 10 on a downstream end of an isolation element 84, and then inserting the assembly into lateral well 80 adjacent water producing zone 82. The above described assembly and operation of the tool 10 allows the isolation element 84 to be steered into the lateral well 80, which in one example is referred to as a designated wellbore. A work string 86, is shown attached to an end of the isolation element 84 distal from where it attaches to the tool 10. The work string 86 is shown as a generally tubular member and can be made up of coiled tubing, drill pipe and other members for disposing elements downhole.

Figure 10C:
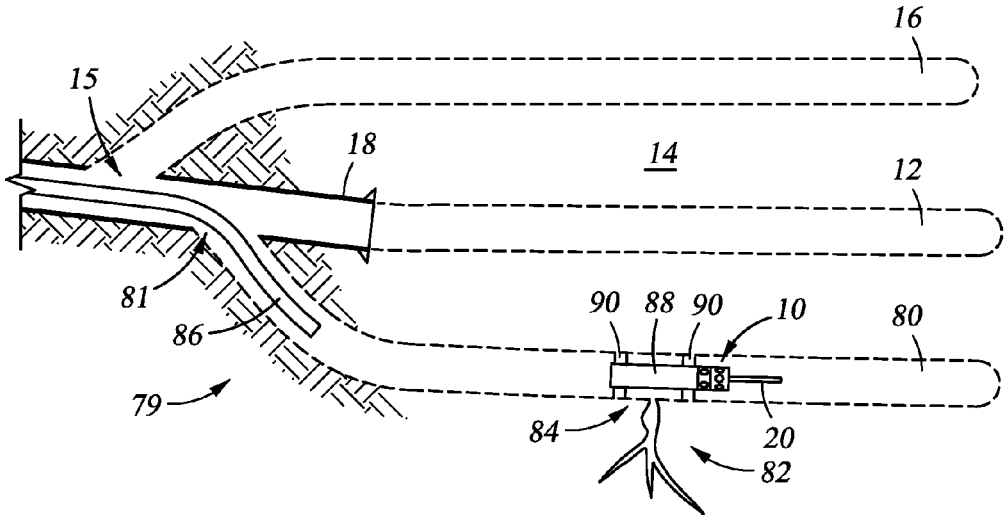
Figure 10D:
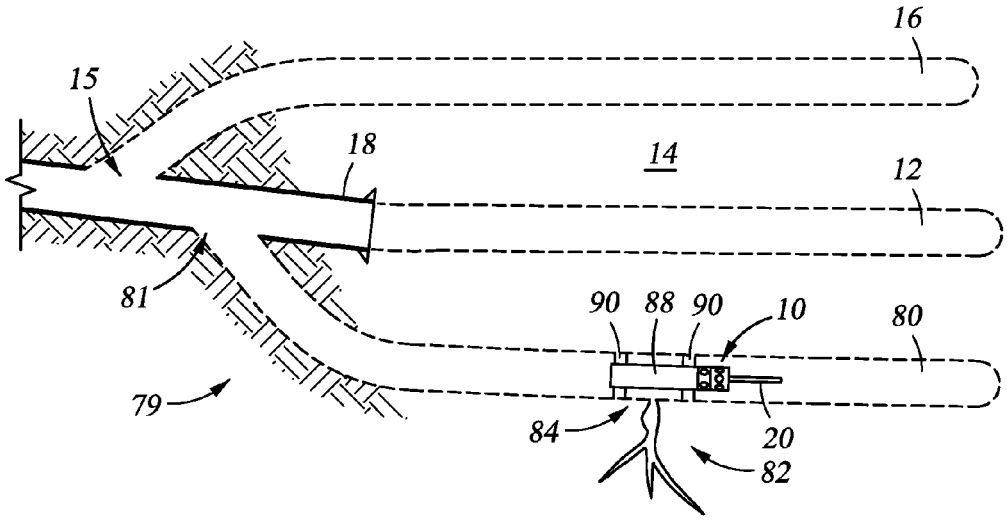

Still referring to FIG. 10B, the isolation element 84 includes an annular body 88 and having packers 90 on its outer surface. Packers 90 are shown axially spaced apart on distal ends of the body 88, so that when packers 90 extend radially outward into contact with walls of lateral. wellbore 80, they plug wellbore 80 above and below where water producing zone 82 intersects wellbore 80. As such, communication between the water producing zone 82 and lateral wellbore 80 is precluded by installation of the isolation element 84. FIGS. 10C and 10D illustrate disconnection of the work string 86 from isolation element 84, thereby leaving isolation element 84 in place to continue blocking communication between the water producing zone 82 and lateral well 80.

Figure 11:
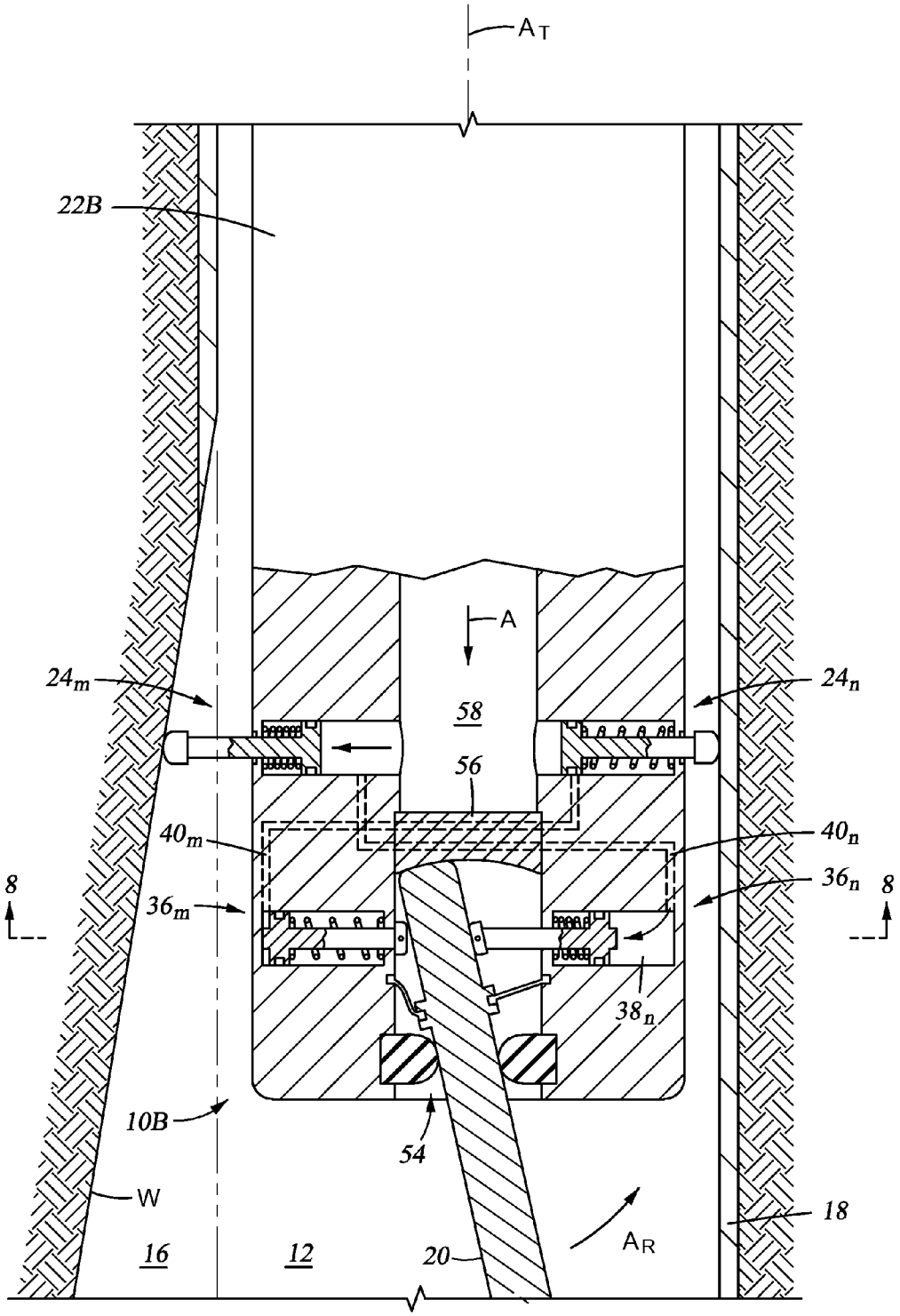
FIG. 11 is a side sectional view of a portion of an alternate embodiment of the downhole tool of FIG. 1 in accordance with the present invention.

Referring now to FIG. 11, a side sectional view of an alternate embodiment of a downhole tool 10B is shown. In this example, probe assembly $24_n$ is shown retracted and set against the body 22B of tool 10B. On a circumference of body 22B distal from probe assembly $\mathbf{24}_n$, is probe assembly $\mathbf{24}_m$ shown extended away from body 22B. in the example of FIG. 11, the number of probe assemblies can range from two up to eight or more. Thus, when the number of probe assemblies is greater than two, probe assembly 24, is in one example on an opposite azimuthal position from probe assembly $\mathbf{24}_m$. Further, in the example of FIG. 11, probe assembly $\mathbf{24}_n$ is retracted inward due to contact with casing 18 that lines a motherbore 12, whereas probe assembly $\mathbf{24}_m$ is adjacent to where lateral wellbore 16 branches outward from motherbore 12, and thus is able to bias outward from pressure within bore 58 and into contact with wall W. Unlike the arrangement of FIG. 4, the communication of fluid is between probe assemblies $\mathbf{24}_n$, $\mathbf{24}_m$ and piston assemblies $\mathbf{26}_n$, $\mathbf{26}_m$ that are on opposing azimuths on the tool body 22B. More specifically, passage $\mathbf{40}\mathrm{B}_m$ is shown having one end connected to cylinder $\mathbf{30}_m$ and a distal end connecting to cylinder $\mathbf{38}_N$. As such, extending probe assembly $\mathbf{24}_m$ causes piston assembly $\mathbf{36}_n$ to project radially inward and pivot the tool guide 20 in a direction opposite from where probe assembly $\mathbf{24}_m$ is set on tool body 22B. Thus, in the example of FIG. 11, unlike in FIGS. 2 and 3, tool guide 20 will continue to project into the motherbore 12 rather than lateral wellbore 16 as tool 10B is urged deeper in motherbore 12.

Figure 12A:
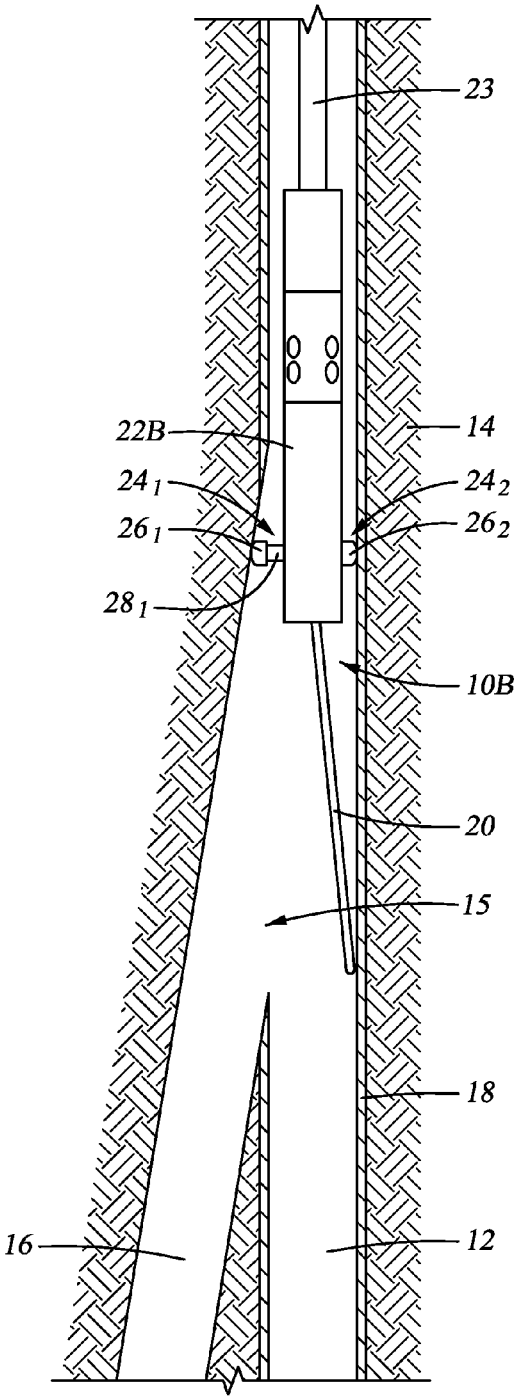
FIGS. 12A and 12B are side sectional views of the downhole tool of FIG. 11 in use in a multilateral well and in accordance with the present invention.
Figure 12B:
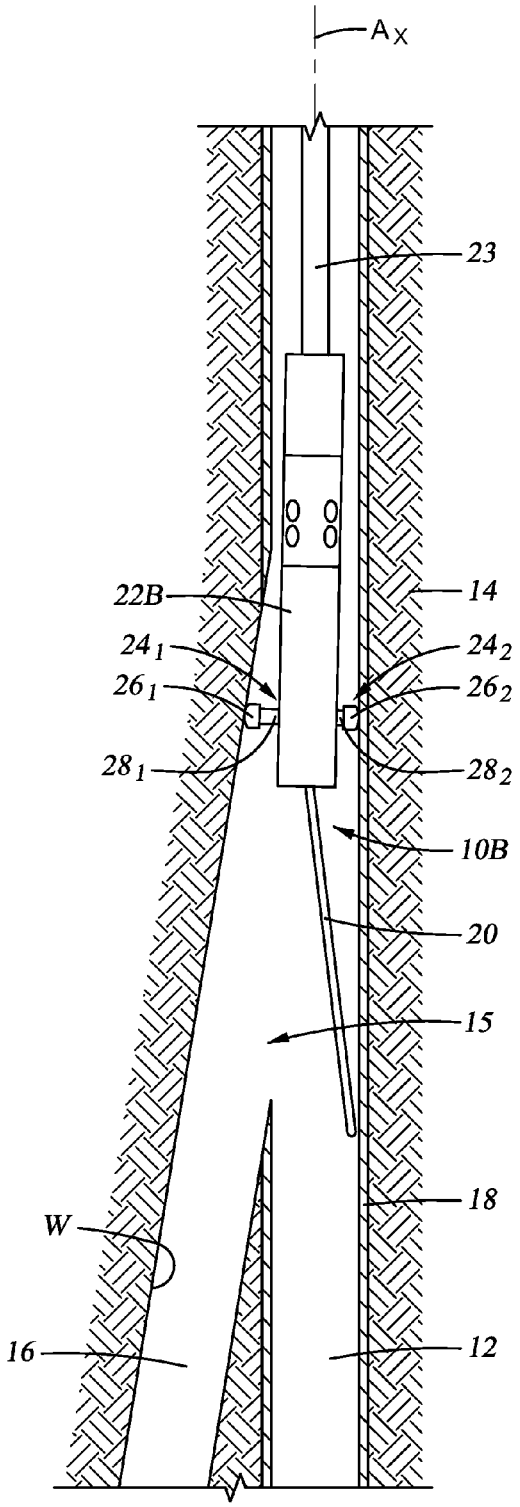

FIGS. 12A and 12B illustrate operation of the tool 10B of FIG. 11 and as shown in FIG. 12A illustrate how projecting probe assembly $\mathbf{24}_1$ radially outward from tool body 22B causes tool guide 20 to pivot into motherbore 12 rather than into lateral wellbore 16. FIG. 12B illustrates further movement of tool 10B into motherbore 12 so that tool 10B can be guided into motherbore 12 and not into lateral wellbore 16.

Figure 13:
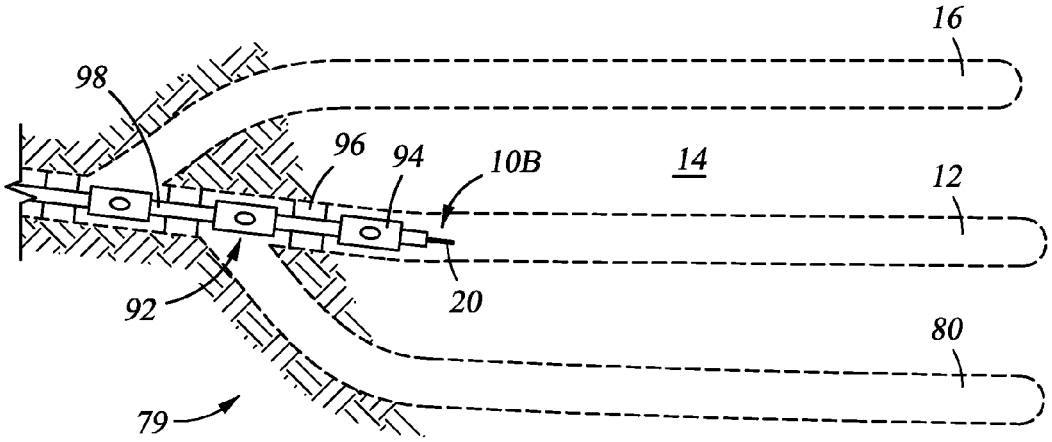
FIG. 13 is a side partial sectional view of an example embodiment of a downhole tool guiding a downhole string into a designated wellbore of a multilateral well and in accordance with the present invention.

FIG. 13 illustrates a partial sectional view of tool 10B being used to guide and steer a completion string 92 into a motherbore 12 that is part of a multilateral wellbore 79. In this example, the motherbore 12 is not cased, thus the lateral wellbores 16, 80 are drilled by open-hole sidetracks, which reduces well cost. Further in this example, the completion string 92 includes control valves 94 along its length for regulating flow through the string 92 and isolation packers 96 set at axially spaced apart locations along the length of the string 92. Optionally, a control line 98 may he included with string 92 that extends along the length of string 92 and for delivering and/or receiving control signals throughout string 92. In this example, strategic operation of control valves 94 allows selective production from wellbores 12, 16, 80.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. A guide system for use in a wellbore having a motherbore and a lateral wellbore, the system comprising:

a body;

a probe assembly selectively extendable from a lateral side of the body between an undeployed position in contact with a wall of the motherbore, and a deployed position in contact with a wall of the lateral wellbore;

a guide member projecting from an end of the body and directed towards a designated wellbore when the probe assembly is in the deployed position; and a steering system in the body responsive to a change between the undeployed and deployed positions of the probe assembly to selectively move the guide member from an orientation where the guide member is directed away from the designated wellbore and to an orientation where the guide member is directed towards the designated wellbore.

2. The guide system of claim 1, wherein the designated wellbore comprises a wellbore selected from the group consisting of the motherbore and the lateral wellbore.

3. The guide system of claim 1, further comprising a fluid passage in the body that extends between the probe assembly and the steering system.

4. The guide system of claim 3, wherein the probe assembly comprises a cylinder that extends radially outward from a bore in the body and that is intersected by the fluid passage, a piston head axially slidable in the cylinder, and a probe tip connected to the piston head by a rod, so that when the probe tip is adjacent a wall of the lateral wellbore, pressurized fluid in the bore urges the piston head, rod, and probe tip radially outward into contact with the wall of the lateral wellbore.

5. The guide system of claim 4, wherein the probe assembly is in the deployed position when the piston head is urged radially outward from where the passage intersects the cylinder and wherein the pressurized fluid from the bore is directed to the steering system through the passage.

6. The guide system of claim 3, wherein the steering system comprises a cylinder that is intersected by the passage, a piston head slidable in the cylinder, a rod projecting radially inward from the piston head that contacts the guide member, and a spring biasing the piston head radially outward.

7. The guide system of claim 1, further comprising resilient members attached to sides of the guide member, so that the guide member is substantially collinear with an axis of the body when the probe assembly is in the undeployed position.

8. The guide system of claim 1, wherein the probe assembly and steering system are at substantially distal azimuthal locations on the body, and wherein the designated wellbore is a motherbore.

9. The guide system of claim 1, further comprising a plurality of probe assemblies in the body, a plurality of steering systems positioned in the body, so that each of the steering systems are at about the same angular position as a corresponding probe assembly, and so that when a one of the probe assemblies is in a deployed position, a corresponding steering system is moved into contact with the guide member to orient the guide member into a designated wellbore.

10. A tool string insertable into a multilateral wellbore having lateral wellbores that branch from a motherbore, the tool string comprising:

a tubing string that selectively receives pressurized fluid from a fluid source;

a tool body attached to an end of the tubing string;

a bore in the tool body in fluid communication with the pressurized fluid;

a guide member pivotingly mounted in the body and having a portion extending from an end of the body;

a flow path in the body in fluid communication with the bore in the tool body;

a probe assembly in the body selectively moveable from in a position that defines a flow barrier in the flow path and in contact with a wall of the multilateral wellbore, to a position offset from the flow path and projecting into the lateral wellbore; and a steering assembly mounted in the body having an end in communication with the flow path, and moveable against the guide member to an orientation where the guide member is directed towards one of the motherbore or the lateral wellbore when the probe is offset from the flowpath.

11. The tool string of claim 10, wherein the probe assembly and steering assembly are set at about the same azimuthal location on the body and the designated wellbore is a lateral wellbore.

12. The tool string of claim 10, wherein the probe assembly and steering assembly are set at substantially distal azimuthal locations on the body and the designated wellbore is a motherbore.

13. The tool string of claim 10, wherein the probe assembly comprises a cylinder in the body that projects radially outward from the bore in the body, a piston assembly set in the cylinder having a piston head with a inner surface facing the bore, a piston rod on an outer surface, a probe tip on an end of the rod distal from the piston head, and a spring exerting a radially inward biasing force onto the piston head, piston rod, and probe tip.

14. The tool string of claim 13, wherein the steering assembly comprises a cylinder in the body that projects radially inward to intersect with the bore in the body, a piston assembly set in the cylinder having a piston head with an outer surface and a rod on an inner surface of the piston head.

15. The tool string of claim 14, further comprising a flow passage in the body having an end connected with the cylinder in the probe assembly and a distal end connected with the cylinder in the steering assembly.

16. The tool string of claim 10, further comprising a plurality of probe assemblies, and a plurality of steering assemblies, wherein each steering assembly is set at the same azimuthal location in the body as a corresponding probe assembly.

17. The tool string of claim 10, further comprising selectively deployable packers for controlling fluid flow in the wellbore.

18. A method of selective insertion into a designated wellbore that is part of a multilateral wellbore, the method comprising:

(a) providing a steering tool having an elongated guide projecting from a body of the steering tool;

(b) inserting the steering tool into the multilateral wellbore;

(c) identifying an entrance to a lateral wellbore by sensing a wall of a wellbore surrounding the body with probes that are urged radially outward from the body at azimuthally spaced locations around the body; and (d) directing the guide towards the designated wellbore in response to radial movement of the probes.

19. The method of claim 18, wherein probes proximate the entrance extend past probes distal from the entrance.

20. The method of claim 18, wherein when the designated wellbore is the lateral wellbore, the guide is directed towards the lateral wellbore, and wherein when the designated wellbore is the motherbore, the guide directed away from the lateral wellbore.

* * * * *